US006151862A

United States Patent [19]

Griesau

[11] Patent Number: 6,151,862

[45] Date of Patent: Nov. 28, 2000

[54] CONTAINER COVER CLOSURE APPARATUS

[75] Inventor: Richard A. Griesau, Scotia, N.Y.

[73] Assignee: The United States of America as represented by the United States Department of Energy, Washington, D.C.

[21] Appl. No.: 09/265,873

[22] Filed: Mar. 11, 1999

[51] Int. Cl.[7] ..... B65B 43/26

[52] U.S. Cl. ..... 53/381.1; 53/381.4

[58] Field of Search ..... 53/492, 381.1, 53/381.4, 390, 138.1; 414/411

[56] References Cited

U.S. PATENT DOCUMENTS

| | | | |
|---|---|---|---|
| 3,972,454 | 8/1976 | Croley | 414/411 |
| 4,676,712 | 6/1987 | Hayward et al. | 414/411 |
| 4,693,017 | 9/1987 | Oehler et al. | 414/411 |
| 4,722,270 | 2/1988 | Wall | 414/411 |
| 5,048,259 | 9/1991 | Cox et al. | 53/381.4 |
| 5,235,795 | 8/1993 | DeBusk | 414/411 |

*Primary Examiner*—Eugene Kim
*Attorney, Agent, or Firm*—John T. Lucas; William R. Moser; Paul A. Gottlieb

[57] ABSTRACT

The present invention relates generally to handling and/or storing hazardous waste materials, such as radioactive materials, and is more specifically directed to loading and/or unloading radioactive material into or out of a container, such as a drum, by remote operation, and more particularly the present invention relates to the remote opening and/or closing of a container secured by a compression ring.

19 Claims, 2 Drawing Sheets

CONTAINER COVER CLOSURE APPARATUS

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. DE-AC12-76SN00052 awarded by U.S. Department of Energy.

CROSS-REFERENCE TO RELATED APPLICATIONS

Not Applicable.

AUTHORIZATION PURSUANT TO 37 C.F.R. §1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to an apparatus and process for handling and/or storing hazardous waste, such as radioactive materials. More specifically, the present invention relates to an apparatus and process for loading and/or unloading radioactive material into or out of containers by remote operation. Specifically, the present invention relates to the remote opening and/or closing of a container cover secured by a compression ring.

2. Description of the Related Art

Prior to the present invention, a qualified radiation worker would be required to insert/remove a drum cover closure ring on a container or drum for radioactive material by hand, thereby directly exposing the individual at close range to potentially high levels of radiation.

In accordance with the apparatus of the present invention, a ring may be remotely inserted or removed using a small jib crane and two fluid control valves for ring gripping and expanding from behind a radiation shield in order to reduce, minimize and/or avoid exposing the radiation worker to radiation.

BRIEF SUMMARY OF THE INVENTION

The present invention relates generally to handling and/or storing hazardous waste materials, such as radioactive materials, and is more specifically directed to loading and/or unloading radioactive material into or out of a container, such as a drum, by remote operation, and more particularly the present invention relates to the remote opening and/or closing of a container secured by a compression ring.

The present invention intended to be claimed includes an apparatus for opening and/or closing a container, wherein the apparatus includes a support plate; a plurality of gripping assemblies comprising at least one arm mounted radially on the support, a gripping edge and means for gripping fitted on each arm; and, means for closing over a cover seated in the means for gripping.

The apparatus of the present invention preferably also includes at least one fluid ram operatively associated with the means for gripping and the means for closing.

For purposes of the present invention, the plurality of gripping assemblies preferably comprise four gripping assemblies; and the means for closing preferably comprises an arcuate member having opposite ends, wherein the arcuate member comprises a convex and concave surface and an inner lip, preferably wherein the arcuate member comprises a closure which is substantially ring-shaped.

In accordance with the present invention, the fluid ram pushes against the closure at a predetermined angle off the horizontal plane of the closure until the closure is seated in the gripping edge.

For purposes of the present invention, the arms of at least two of the plurality of gripping assemblies are fixed on said support plate, wherein the arms of two of the plurality of gripping assemblies are adjustable and are mounted by way of slide tubes on said support plate.

The apparatus of the present invention also includes push rods operatively connected to means for radially activating the adjustable arms, wherein the means for radially activating comprises an expansion fluid ram.

The apparatus of the present invention also includes means for biasing the push rods that are operatively connected on the adjustable arms for retracting the adjustable arms wherein the means for biasing comprises a spring.

The apparatus of the present invention also includes means for moving the apparatus operatively mounted substantially at the horizontal center and vertically above the center of mass of the support plate, preferably wherein the means for moving comprises an eyebolt.

The apparatus of the present invention may also include a jib crane operatively associated with the eyebolt for remotely moving the support plate.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
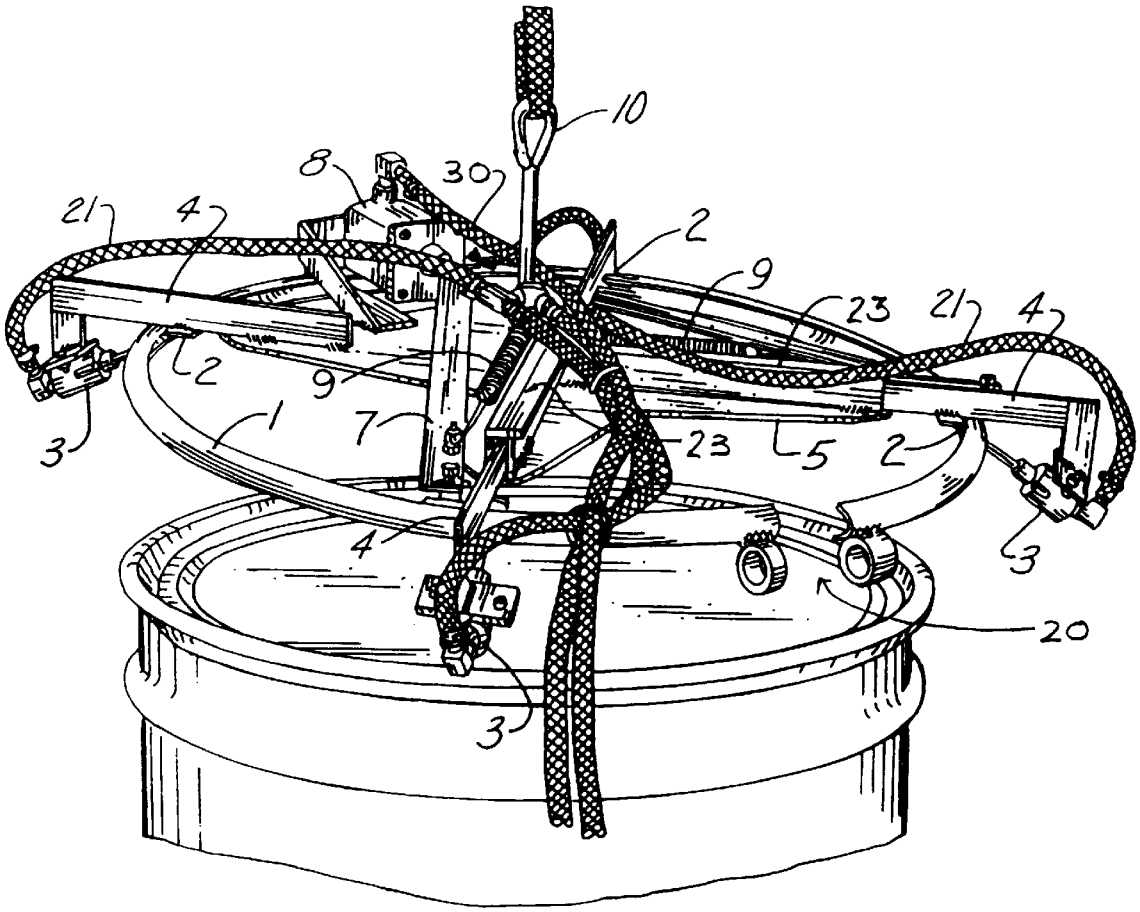
FIG. 1 shows the ring and tool of the present invention positioned over a drum and cover.

In general, the present invention intended to be claimed is described in reference to the figures as an apparatus for opening or closing a container which includes a support plate, a plurality of gripping assemblies comprising arms mounted radially on the support plate, means for gripping fitted on each of said plurality of arms and means for closing over a cover seated in the means for gripping. At least one fluid ram is operatively associated with the means for gripping and the means for closing. As used herein, a plurality of gripping assemblies preferably includes four gripping assemblies.

Due to the varied environments that the apparatus of the present invention could be used in, there are several materials that could be used for the components of the tool. The materials used in the application that the tool was designed for are provided in Table 1.

TABLE 1

| | Part Names | Source of Parts | Materials/Requirements |
|---|---|---|---|
| 1 | COMPRESSION RING | Commercially available | standard steel 55 gallon compression ring |
| 2 | RING GRIPPING EDGE | Fabricated | cold rolled steel flat stock |
| 3 | Gripping Fluid Ram | Commercially available | ⅞" bore × ¾" stroke. Operated at approx. 80 psig metallic materials preferred. |
| 4 | SUPPORT ARM (FIXED and ADJUSTABLE) | Commercially available or fabricated | ¼" × 1" cold rolled steel flat stock. Commercially available arms could be used as long as they are of sufficient strength to accommodate the longitudinal and lateral thrusts generated during ring expansion. |
| 5 | SUPPORT PLATE OF CENTRAL SUPPORT PLATE | Fabricated | fabricated from hot rolled steel |
| 7 | PUSH ROD | Fabricated | cold rolled steel flat stock |
| 8 | EXPANSION FLUID RAM | Commercially available | 2.0" bore × 2.0" stroke. Operated at approx. 40 psig metallic materials preferred. |
| 9 | SPRING | Commercially available | standard |
| 10 | EYEBOLT of CENTRAL SUPPORT PLATE | Commercially available | mild steel or stainless steel |
| 20 | RING OPENING | Not applicable | Not applicable |
| 21 30 40 | HOSES | Commercially available | standard |
| 22 | PARALLEL DISTRIBUTION MANIFOLD | Commercially available | standard |
| 23 | SUPPORT ARM SLIDE TUBE of ADJUSTABLE ARMS | Fabricated | tube was fabricated from (3) ¼" × 1" cold rolled steel flat stock whose bore would accept the ¼" × 1" support arm end |
| 24 | COUPLING BRACKET of EXPANSION FLUID RAM | Fabricated | standard mild steel or stainless steel |
| 25 | BASE BRACKET of EXPANSION FLUID RAM | Fabricated | standard mild steel or stainless steel |

General materials specifications are as follows:

Any liquid or gas may be used to actuate the expansion fluid ram or fluid rams.

For corrosive environments, the preferred fabrication materials are mild steel or stainless steel.

Although not necessary, it may be desirable to surface hardened all of the surfaces of the apparatus that contact the compression ring to prevent wear and galling of these surfaces when sliding occurs during expansion of the ring.

Preferably the parts may be fabricated of high strength plastic. However, plastics would not be particularly suitable in applications in which the plastic would be deteriorated by ionizing radiation fields.

Stainless steel, plastics or non-corrosive coatings may be used for components in applications that require the apparatus to be submersed in liquid.

In accordance with the present invention, the means for closing includes an arcuate member having opposite ends, wherein the arcuate member comprises a gripping edge, including concave and convex surfaces, forming a closure which is substantially ring-shaped.

In accordance with the present invention, the arms of at least two of the plurality of gripping assemblies are fixed on the support plate; and the arms of at least two of the plurality of gripping assemblies are adjustable and are mounted by way of slide tubes on the support plate wherein push rods are operatively connected to an expansion fluid ram for activating the adjustable arms.

The apparatus of the present invention also includes means for biasing the push rods that are operatively connected on the adjustable arms for retracting the adjustable arms. Preferably, means for biasing comprises a spring.

The apparatus of the present invention also includes means for moving the apparatus operatively mounted substantially at the horizontal center and vertically above the center of mass of the support plate. In accordance with the present invention, means for moving includes an eyebolt, and preferably a jib crane for remotely moving the support plate.

In accordance with the present invention, at least one fluid rarn pushes against the closure at a predetermined angle off the horizontal plane of said closure until the closure is seated in the gripping edge.

More specifically, referring to the figures, the present invention is directed to an apparatus comprising a mechanical device which expands and retracts a container cover closure ring (1) for insertion or removal with respect to a container. In accordance with the present invention, the ring is remotely inserted or removed using a small jib crane (not shown) and two fluid control valves (not shown) for ring gripping and expanding from behind a radiation shield (not shown).

For purposes of the present invention, in general the functional components include a ring (1) and a plurality of gripping assemblies which are most preferably four (4) in number. The ring preferably consists of compound concave/convex surfaces and an inner lip. Each gripping assembly consists of at least one arm mounted radially on a support plate with a gripping edge and a fluid ram fitted on the arm. The ring (1) is held seated in the gripping edges of the gripping assemblies by the four fluid rams (3) which push up against the ring from below and outside the ring (1) at a predetermined angle of about 30 degrees off the horizontal plane of the ring.

Figure 4:
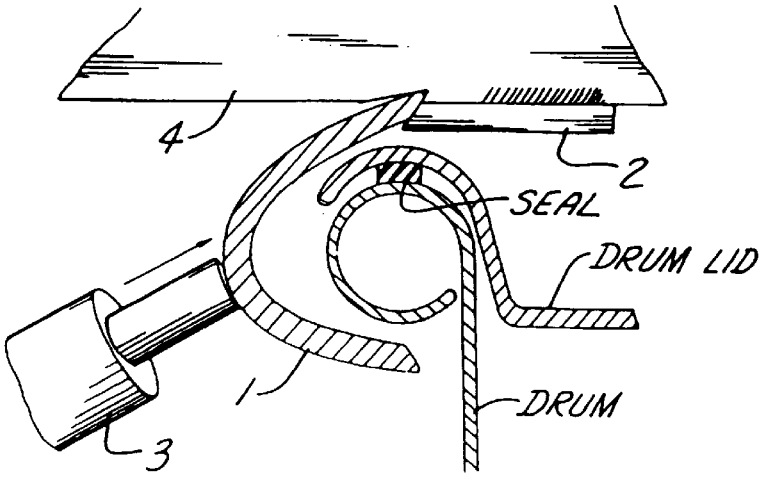
FIG. 4 shows the ring of the present invention contacting the container.

As shown in more detail in FIG. 4, the ring (1) is a compression device. It does not provide a seal. The seal is on the cover located where it contacts the container.

Each of the gripping assemblies described above is held on an arm (4) mounted radially on a support plate (5) at a predetermined angles most preferably about 90° positioned from each other. Two gripping assemblies are provided opposite the ring opening (20) which arms are fixed to the support plate (5), while the arms of the other two gripping assemblies are mounted on the support plate by way of slide tubes (23) and are activated radially by push rods (7) connected to a single expansion fluid ram (8) opposite the ring opening (20) and retracted by springs (9) on each adjustable support arm (4). The entire apparatus is lifted by an eyebolt (10) mounted at the horizontal center of mass and vertically above the center of mass of the support plate.

Detailed descriptions of the components of the present invention and their interconnection and cooperation are provided in Tables 2 and 3 as follows:

TABLE 2

| PARTS INTERCONNECTIONS | | | | | |
|---|---|---|---|---|---|
| Central Support Plate | Fixed Gripping Assembly | Adjustable Gripping Assembly | Standard Compression Ring (1) | Standard Expansion Fluid Ram (8) | Standard Parallel Distribution Manifold (22) |
| Support Plate (5) | T-shaped support arm (4) is welded to the plate (5) | The slide tube (23) is welded to the plate (5). The T-shaped support arm (4) fits securely in the tube | Standard 55 gallon compression ring (1) with a gripping edge including concave and convex surfaces. | Standard expansion fluid ram (8) bolted to a base bracket (25) that is welded to the plate (5)<br>A coupling bracket (24) is bolted over the piston shaft and the push rods (7)<br>A hose (30) is connected from the fluid supply to the ram | A hose (40) from the pressurized fluid supply is connected to the manifold<br>Hoses (21) from the fluid rams (3) are connected to the manifold. |
| eyebolt (10) is welded to the plate (5) | Ring gripping edge (2) is welded on the support arm (4)<br>gripping fluid ram (3) is bolted to support arm (4)<br>hose (21) is clamped to the gripping fluid ram (3) and the distribution manifold (22) | Ring gripping edge (2) is welded on the support arm (4)<br>gripping fluid ram (3) is bolted to support arm (4)<br>hose (21) is clamped to the gripping fluid ram (3) and the distribution manifold (22)<br>one end of push rod (7) is bolted to a bracket on the side of the support arm (4) and other end is bolted to the expansion ram (8) via the ram coupling bracket (24)<br>spring (9) is bolted to the push rod (7) and secured to the eyebolt (10) | | | |

TABLE 3

| PART NAMES | |
|---|---|
| 1 | Compression Ring |
| 2 | Ring Gripping Edge |
| 3 | Gripping Fluid Ram |
| 4 | Support arm |
| 5 | support plate of central support plate |
| 7 | push rod |
| 8 | expansion fluid ram |
| 9 | spring |
| 10 | eyebolt of central support plate |
| 20 | ring opening |
| 21 | hose, gripping fluid ram |
| 22 | parallel distribution manifold |
| 23 | support arm slide tube of adjustable arm |
| 24 | coupling bracket of expansion fluid ram |
| 25 | base bracket of expansion fluid ram |
| 30 | hose, expansion ram |
| 40 | hose, distribution manifold |

More specifically, the functional operating components include a support plate (5), a plurality of gripping assemblies, a compression ring (1) and an expansion fluid ram (8).

The compression ring (1) has concave (inner) and convex (outer) surfaces.

The fixed gripping assemblies consist of a support arm (4), a ring gripping edge (2) and a fluid ram (3). The adjustable gripping assemblies consist of a slide tube (2), an adjustable support arm (4), a push rod (7), a spring (9), a ring gripping edge (2), and a fluid ram (3). When fluid pressure is applied to the ram (3), its piston shaft drives the inner lip of the compression ring (1) into the gripping edge (2) capturing it there but allowing it to slide circumferentially with reference to the ring. The rams (3) capture the ring on the gripping edges (2) so the ring cannot be easily jarred loose in critical hazardous operations.

Two fixed gripping assemblies are mounted by way of the support arms (4) adjacent to and at 90 degree angles to each other on the support plate (5). Two adjustable gripping assemblies are mounted by way of slide tubes (23) at the remaining 90 degree positions on the support plate (5). The adjustable arms allow the adjustable assemblies to translate radially out from and into the physical center defined by the intersection of the longitudinal axes of the four ring grip support arms.

Figure 2:
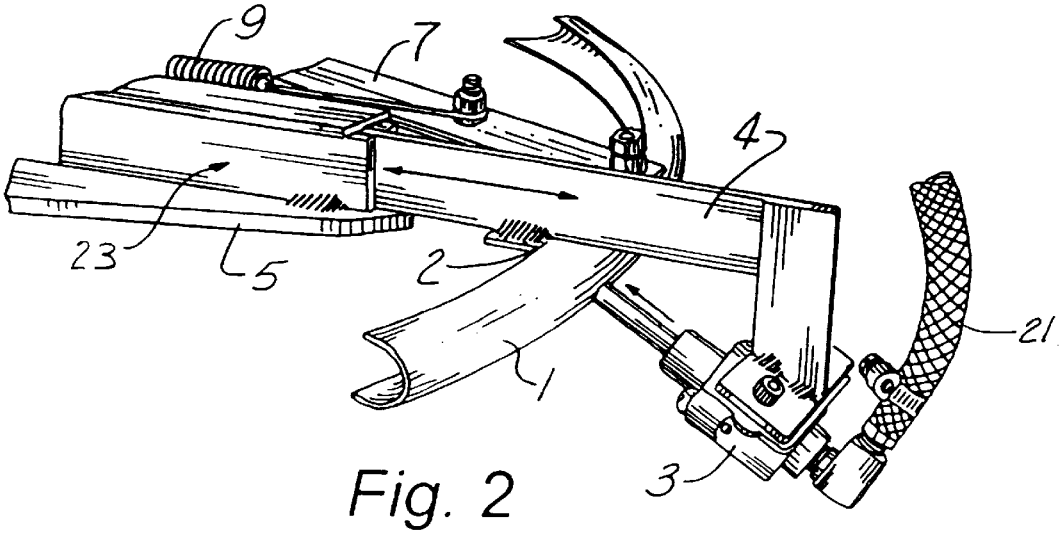
FIG. 2 shows the grip mechanism of the present invention.
Figure 3:
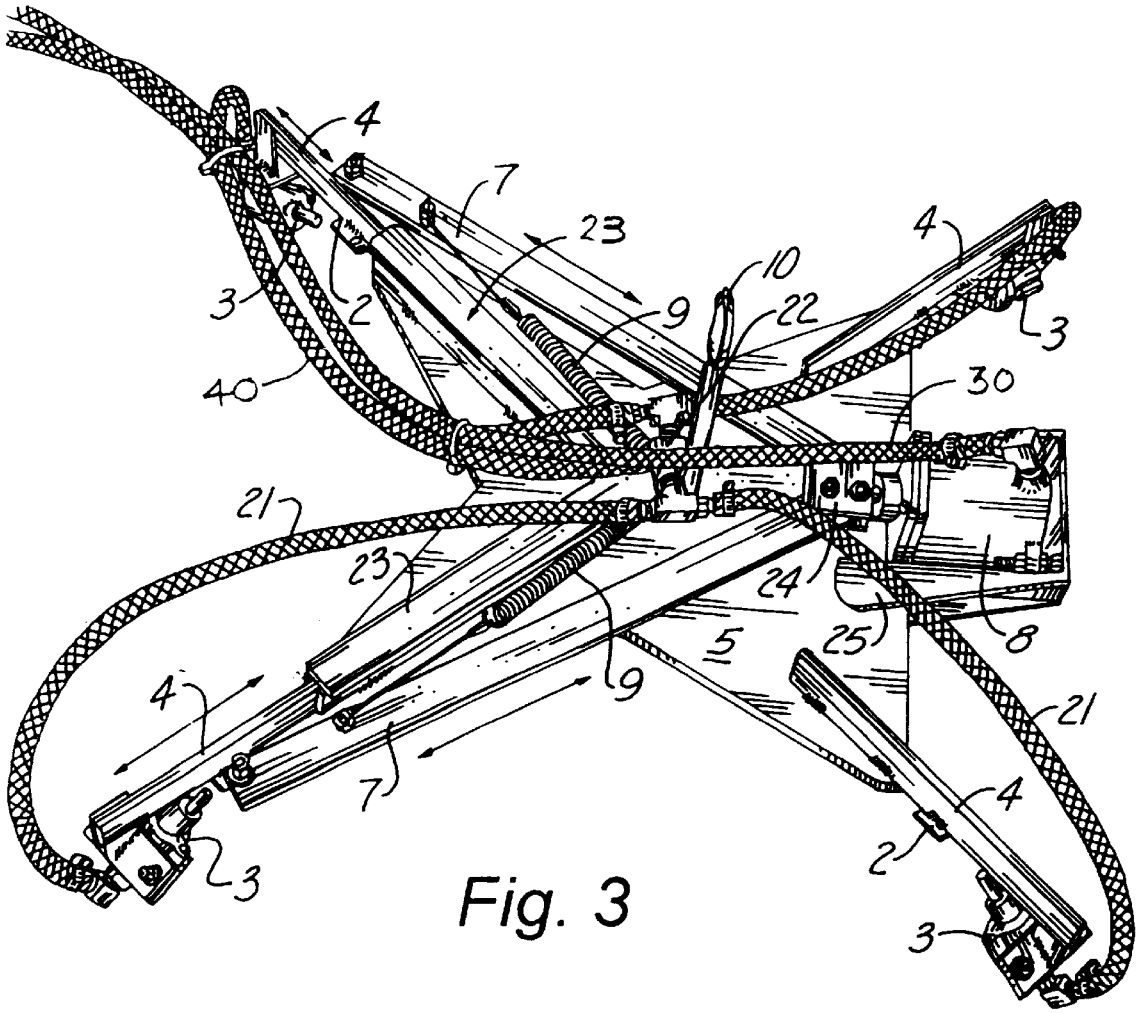
FIG. 3 shows the apparatus of the present invention.

The ring gripping edges (2) of the gripping assemblies are mounted on the bottom of the support arms (4) with the gripping edge (2) facing outward from the physical center defined above. The vertical slope of the gripping edge is angled from bottom to top toward the physical center defined above. The function of the lower outmost portion of the gripping edge is to engage and retain the inner edge of the upper lip of the compression ring. (See FIG. 2)

The ring expansion fluid ram (8) is mounted between the fixed gripping assemblies and above the plane of the support plate (5). The longitudinal axis of the piston shaft of the ram is parallel to the support plate plane and intersects the vertical axis through the physical center defined above. The expansion ram piston shaft is connected to the adjustable support arms (4) by two push rods (7). When the piston shaft expands, the two adjustable gripping assemblies translate radially out from the physical center. Continued application of sufficient fluid pressure to the expansion ram (8), increases the radius of the compression ring, allowing it to be removed from or inserted on the lips of the mated container and cover.

The non-pivoting character of the slide tubes provides alignment stability of all components. However, the ring must slide in the translating gripping edges while it is being expanded. This is accommodated by the convex cut of the gripping edges with a radius matched to the inner radius of the compression ring. A smaller radius would be desirable because it would better accommodate the pitching of the ring at the translating edge positions as the ring is opened.

Depressurization of the expansion fluid ram (8) and all the fluid rams (3) will release the ring from the tool. If the ring is in place around the mated lips of the container and cover prior to depressurization, the ring will be left gripping them.

The tool is transported by an eyebolt (10) that is rigidly connected to the support plate (5). The eyebolt (10) is located above the plane of the plate and centered over the center of mass of the entire apparatus. The apparatus can be lifted and positioned by any device that can be attached to the eyebolt and support the weight of the apparatus with the compression ring.

In operation of the apparatus of the present invention to close a drum cover, the ring (1) is secured in the gripping edges (2) by activating the fluid rams (3) of the gripping assemblies. The ring is then expanded by application of compressed fluid to the expansion fluid ram (8) connected to the push rods (7) of the adjustable gripping assemblies. The apparatus is then set on top of the drum cover. The pressure to the expansion fluid ram (8) and grip assemblies fluid rams (3) is then removed releasing the ring from the apparatus and leaving the ring clamped in place over the drum lip and cover lip providing a sealed closure.

In operation of the apparatus of the present invention to open a drum cover with a ring in place, the tool is set on top of the ring (1) and the ring is secured in the gripping edges (2) by activating the fluid rams (3) of the grip assemblies. The ring (1) is then expanded by application of pressurized fluid to the expansion fluid ram (8). The apparatus is lifted from the top of the drum cover removing the ring from the cover.

Although the apparatus of the present invention has been used to handle radioactive waste, the tool may be used in any environment that precludes operator presence including biohazards, toxic and corrosive chemicals, high temperature or mechanical hazards, etc.

The operating temperature is primarily limited by the operating temperatures of the ram seals and the lubricant in the slide tubes within a range from about −100 degrees F to 400 degrees F.

The apparatus of the present invention may be used in any environmental pressure, including a vacuum, providing that sufficient fluid pressure above the surrounding environment is available to operate the rams to hold the ring in place and expand the ring.

EXAMPLE

This container cover closure apparatus has been used in the transfer of a highly radioactive neutron source from a shielded storage cask to a 55 gallon shipping drum as follows:

All work was performed by the operators with a radiation shield positioned between them and the radiation source. The support frame of the shield held two master/slave remote manipulators. A remote controlled CCTV camera was used for additional visibility into the open cask and the drum.

The steel and lead cask cover was lifted and moved to the side by a remotely operated electric overhead rail crane. The invention tool and a grappling tool for grasping and moving the neutron source were both lifted and positioned with a small jib crane. This was made up of a small beam with a side-to-side swing attached to and pivoting on the box frame supporting the manipulators and shielding. Ropes attached to the beam provided remote side-to-side swing control and fixed pulleys on the beam carried a rope for lifting. The centers of the cask and drum were pre-positioned on the arc of swing of the jib crane lifting hook.

The source was lifted from the open cask with the grappling tool and placed in the inner liner of the drum. The liner was taped closed with the remote manipulators.

The drum cover was secured in place with the compression ring using the apparatus as described in operation of invention to close a drum. The anti-contamination shrouds were lifted off of the drum surfaces with the operator positioned behind a shield. An impact wrench and a long extension rod and socket were used via the remote manipulators to engage and tighten a bolt in the compression ring.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

What is claimed is:

1. Apparatus for opening and closing a container, said apparatus comprising:

a support plate;

a plurality of gripping assemblies comprising at least one arm mounted radially on said support;

means for gripping fitted on each said arm; and, wherein operation of said gripping assemblies and means for gripping is capable of supplying appreciable force radially outward in direction from said support plate; and means for closing over a cover seated in said means for gripping.

2. The apparatus of claim 1, wherein said means for gripping comprises a gripping edge.

3. The apparatus of claim 1, comprising at least one fluid ram operatively associated with said means for gripping and said means for closing.

4. The apparatus of claim 3, wherein said plurality of gripping assemblies comprise four gripping assemblies.

5. The apparatus of claim 4, wherein said means for closing comprises an arcuate member having opposite ends.

6. The apparatus of claim 5, wherein said arcuate member comprises an inner lip.

7. The apparatus of claim 6, wherein said arcuate member comprises concave and convex surfaces.

8. The apparatus of claim 6, wherein said arcuate member comprises a closure.

9. The apparatus of claim 8, wherein said closure is substantially ring-shaped.

10. The apparatus of claim 8, wherein said fluid ram pushes against said closure at a predetermined angle off the horizontal plane of said closure.

11. The apparatus of claim 4, wherein the arms of two of said plurality of gripping assemblies are fixed on said support plate.

12. The apparatus of claim 4, wherein the arms of two of said plurality of gripping assemblies are adjustable and are mounted by way of slide tubes on said support plate.

13. The apparatus of claim 12, comprising push rods operatively connected to means for radially activating said adjustable arms.

14. The apparatus of claim 13, wherein said means for radially activating comprises an expansion fluid ram.

15. The apparatus of claim 13, comprising means for biasing said push rods that are operatively connected on said adjustable arms for retracting said adjustable arms.

16. The apparatus of claim 15, wherein said means for biasing comprises a spring.

17. The apparatus of claim 16, comprising means for moving said apparatus operatively mounted substantially at the horizontal center and vertically above the center of mass of said support plate.

18. The apparatus of claim 17, wherein said means for moving comprises an eyebolt.

19. The apparatus of claim 18, comprising a jib crane operatively associated with said eyebolt for remotely moving said support plate.

* * * * *